US005673056A

United States Patent [19]

Ramanujam et al.

[11] Patent Number: 5,673,056

[45] Date of Patent: Sep. 30, 1997

[54] IDENTICAL SURFACE SHAPED REFLECTORS IN SEMI-TANDEM ARRANGEMENT

[75] Inventors: Parthasarathy Ramanujam, Redondo Beach; Eng-Chong Ha, Torrance; Thomas A. Bockrath, Hawthorne, all of Calif.

[73] Assignee: Hughes Electronics, Los Angeles, Calif.

[21] Appl. No.: 502,436

[22] Filed: Jul. 14, 1995

Related U.S. Application Data

[63] Continuation of Ser. No. 948,191, Sep. 21, 1992, abandoned.

[51] Int. Cl.[6] ..... H01Q 19/00

[52] U.S. Cl. ..... 343/756; 343/781 P; 343/909

[58] Field of Search ..... 343/756, 781 P, 343/836, 837, 909, 781 CA, 912; H01Q 19/00, 19/12, 25/00

[56] References Cited

U.S. PATENT DOCUMENTS

| | | | |
|---|---|---|---|
| 3,898,667 | 8/1975 | Raab | 343/756 |
| 4,575,726 | 3/1986 | Gounder et al. | 343/756 |
| 4,625,214 | 11/1986 | Parekh | 343/756 |
| 4,647,938 | 3/1987 | Roederer et al. | 343/761 |
| 4,665,405 | 5/1987 | Drabowitch et al. | 343/756 |
| 4,757,323 | 7/1988 | Duret et al. | 343/756 |
| 4,792,813 | 12/1988 | Rosen | 343/756 |
| 4,823,143 | 4/1989 | Bockrath | 343/781 P |
| 4,897,151 | 1/1990 | Killackey et al. | 156/630 |
| 5,023,619 | 6/1991 | Balcewicz | 342/361 |

FOREIGN PATENT DOCUMENTS

| | | | |
|---|---|---|---|
| 3 609 084 | 2/1987 | Germany . | |
| 60-19303 | 1/1985 | Japan | 343/756 |
| 63-026005 | 2/1988 | Japan . | |

OTHER PUBLICATIONS

Sata et al, "Shaped Beam Patterns of the Offset Composite Reflector Antenna", NEC Researche & Development No. 64, Jan. 1982.

Parekh et al, "Avanced Satcom Communication Antennas", RCA Astro–Electronic, MS–100A.

*Primary Examiner*—Donald T. Hajec
*Assistant Examiner*—Tan Ho
*Attorney, Agent, or Firm*—Elizabeth E. Leitereg; Terje Gudmestad; Wanda K. Denson-Low

[57] ABSTRACT

A pair of dual-gridded shaped reflectors (10) and (20) are arranged one behind the other for transmitting and receiving orthogonally polarized energy waves. A front reflector (10) has a first shaped reflective surface (12) formed on a first body surface (14) for providing a first shaped beam coverage. A rear reflector (20) has a second reflective surface (22) formed on a second body surface (24) for providing a second shaped beam coverage. The first and second reflective surfaces (12) and (22) have substantially identical surface contours and include reflective grids (13) and (23). The reflective grids (13) and (23) are orthogonal with respect to each other so as to handle orthogonally polarized energy. The first and second shaped reflective surfaces (12) and (22) are arranged offset and tandem from each other so as to provide first and second focal points (16) and (26) separate from each other while providing substantially identical first and second shaped beam coverages (15) and (25). As a result, the front and rear reflectors (10) and (20) may be fabricated with a single mandrel (30).

20 Claims, 2 Drawing Sheets

IDENTICAL SURFACE SHAPED REFLECTORS IN SEMI-TANDEM ARRANGEMENT

This is a continuation application of Ser. No. 07/948,191, filed Sep. 21, 1992 now abandoned.

BACKGROUND OF THE INVENTION

1. Technical Field

This invention relates generally to antenna reflector systems and, more particularly, to arranging two dual-gridded shaped reflectors for transmitting and/or receiving orthogonally polarized energy waves.

2. Discussion

Many conventional antenna systems typically employ reflectors which commonly have a parabolic-like surface contour. Shaped reflectors are generally used to collimate or focus a beam of energy so as to obtain high radiation efficiency in a shaped beam pattern. In doing so, a feed horn is generally employed to communicate with the shaped surface contour of the reflector so as to radiate energy off the reflector and/or receive energy therefrom. It is generally known that a shaped reflector advantageously allows the use of a single feed horn to obtain the desired beam pattern.

Energy waves such as those employed in the radio frequency spectrum frequently have two orthogonal components which are orthogonally polarized with respect to each other. The first orthogonal component is conventionally known as the horizontal component, while the second is generally known as the vertical component. The orthogonal polarization of energy waves allows for the possibility of broadcasting two different signals at the same operating frequency. In doing so, one signal is derived from the horizontally polarized component and the second signal is derived from the vertically polarized component.

Known antenna systems have generally employed orthogonally polarized components to double the information sent at the same frequency by using two separate antennas. More recently, conventional antenna systems have employed two reflectors arranged in a shared aperture tandem arrangement so that one reflector is positioned directly behind the other. Each of the two reflectors typically have an array of reflective grid lines which form reflective surfaces. The grid lines on one reflector reflect signals which have a first polarity. In contrast, the grid lines on the other reflector are arranged orthogonal to those of the first and reflect signals which have a second polarity.

In accordance with the conventional two reflector tandem arrangement, each reflector has its own focal point in which an associated feed horn is usually positioned to communicate therewith. Since each feed horn may not occupy the same physical location, the conventional approach requires that the reflectors generally be formed with slightly different shapes. This approach prevents the focal points from converging along a common focal axis while providing somewhat equal shaped beam patterns with similar gain contours.

The conventional orthogonally polarized reflector arrangement generally requires two shaped reflectors which have different shaped reflective surfaces. The different shaped reflectors are individually formed with two separate mandrels or other casting devices. As a result, two separate mandrels are usually required in order to form reflectors which have a particular shaped beam coverage. This requirement generally involves a considerable amount of cost and time to design and produce the separate mandrels.

It is therefore an object of the present invention to provide for a reflector arrangement which has shaped reflectors that may be formed with a single mandrel. In particular, it is desirable to provide for two dual-gridded reflectors which have identical shaped reflective surfaces for transmitting and/or receiving orthogonally polarized energy. It is further desirable to provide for a method of forming the reflectors for such a reflector arrangement.

SUMMARY OF THE INVENTION

In accordance with the teachings of the present invention, a shaped reflector arrangement is provided for reflecting orthogonally polarized energy. The reflector arrangement includes a first shaped reflective surface formed on a first reflector body surface for providing a first shaped beam coverage. A second shaped reflective surface is provided on a second reflector body surface for providing a second shaped beam coverage. The first and second shaped reflective surfaces have substantially identical surface shapes and are arranged in an offset and tandem arrangement so that the first and second reflective surfaces have separate first and second focal points while providing substantially identical first and second shaped beam coverages.

BRIEF DESCRIPTION OF THE DRAWINGS

Other objects and advantages of the present invention will become apparent to those skilled in the art upon reading the following detailed description and upon reference to the drawings in which.

DETAILED DESCRIPTION OF THE PREFERRED EMBODIMENT

Figure 1:
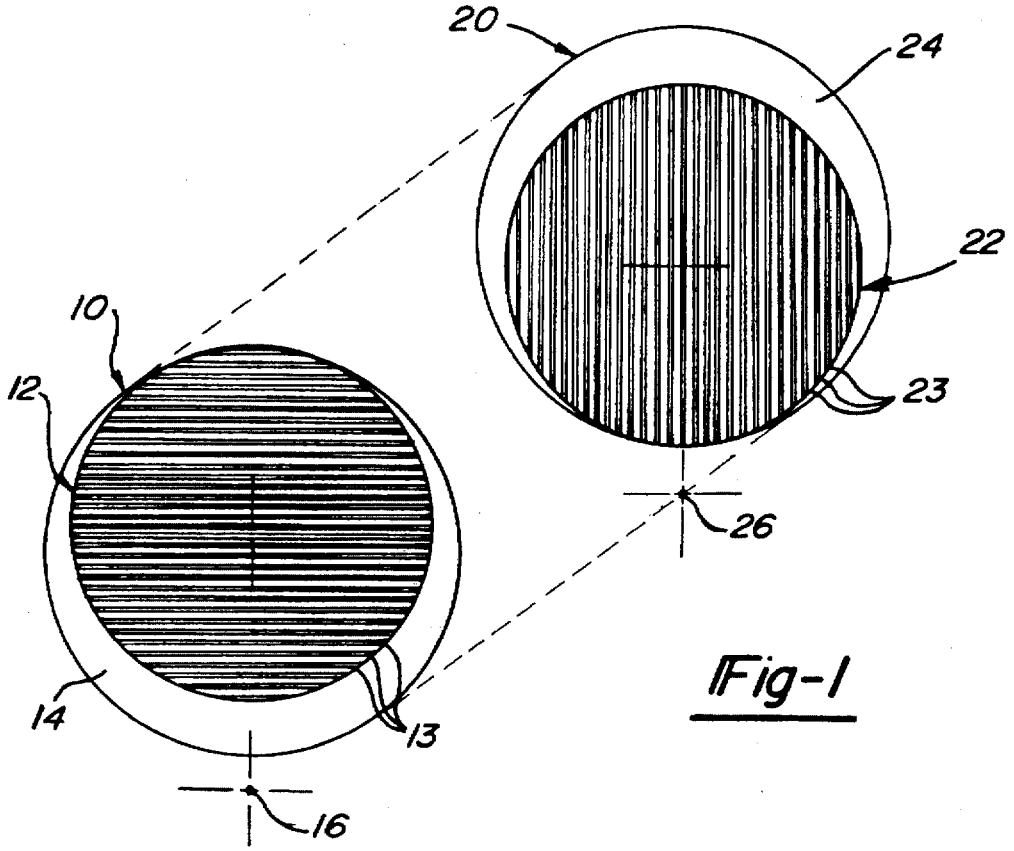
FIG. 1 is an exploded view of a dual-gridded shaped reflector arrangement in accordance with the present invention.
Figure 2:
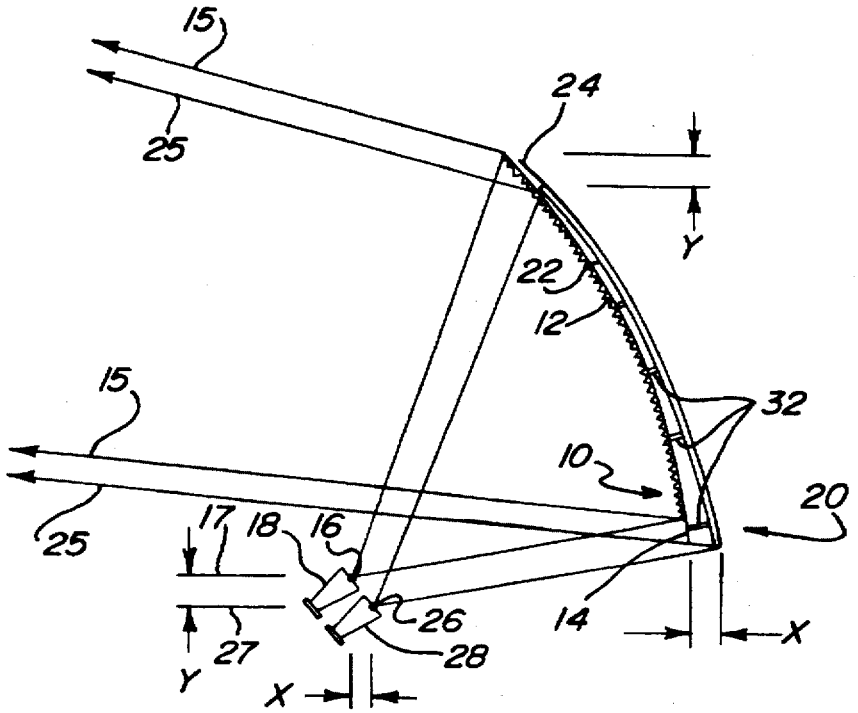
FIG. 2 is a side view of the dual-gridded shaped reflector arrangement in accordance with the present invention.

Turning now to FIGS. 1 and 2, a pair of shaped reflectors 10 and 20 are shown arranged in a tandem arrangement, one behind the other. The shaped reflectors 10 and 20 have identical shaped dual-gridded reflective portions for transmitting orthogonally polarized signals within substantially identical beam patterns. However, the reflective portions are offset from one another to provide for separate focal axes with separate focal points. The shaped reflector arrangement according to the present invention allows for the pair of reflectors 10 and 20 to be formed with a single mandrel.

The first or front shaped reflector 10 includes a first shaped reflective surface 12. The reflective surface 12 is made up of a first array of substantially parallel grid line strips 13 which form a horizontal grid pattern. The front reflector 10 further includes a first shell-like body member 14. The first reflective surface 12 is formed on a portion of the first shell-like body member 14. As a result, the first shell-like body member 14 surrounds the back side of the first shaped reflective surface 12 and further extends over extended portions thereon.

The second or rear shaped reflector 20 has a second reflective surface 22 which is likewise made up of a second array of substantially parallel grid line strips 23. The grid line strips 23 form a vertical grid which is orthogonal to the horizontal grid provided by the first array of grid line strips 13. As a result, the first reflective surface 12 reflects energy polarized in a first direction while the second reflective surface 22 reflects energy polarized in a second direction which is orthogonal to the first direction.

The rear reflector 20 likewise includes a second shell-like body member 24. The second reflective surface 22 is formed on a portion of the second shell-like body member 24. The second reflective surface 22 is formed with a shaped surface contour identical to that of the first reflective surface 12. However, the first and second shell-like body members 14 and 24 generally do not have identical surface contours. Instead, the shell-like body members 14 and 24 position the reflective surfaces 12 and 22 in an offset orientation while providing extensions so that the body members 14 and 24 are substantially equal sized and positioned one behind the other.

The reflective grid line strips 13 and 23 may be formed on the first and second body members 14 and 24 in a number of ways. In a preferred embodiment, wires or thin copper strips are etched on a thin polyimide film which in turn is embedded within or adhered to the first and second shell-like body members 14 and 24. Alternately, the grid line strips 13 and 23 may include precision etched copper lines etched in a suitable dielectric carrier which is formed in or adhered to the body members 14 and 24.

Each of the first and second reflective surfaces 12 and 22 are transparent to incident energy polarized in a direction orthogonal to the reflective grid formed thereon. In other words, the first reflective surface 12 bearing the horizontal grid is transparent to vertically polarized incident energy. Likewise, the second reflective surface 22 bearing the vertical grid is transparent to incident energy signals polarized horizontally.

As shown in FIG. 2, the front and rear shaped reflectors 10 and 20 are arranged so that the front reflector 10 is located directly in front of the rear reflector 20. The front and rear reflectors 10 and 20 are connected together and held in a desired position by a plurality of spaced connectors 32. As a result, the first shell-like body member 14 is located directly in front of the second shell-like body member 24 in a tandem arrangement so that the front and rear shaped reflectors 10 and 20 are compactly arranged within a common shared aperture. The first and second body members 14 and 24 generally have different surface shapes, however the reflective portions 12 and 22 formed thereon have identical surface contours with grid patterns arranged orthogonal to each other. That is, the first and second reflective surfaces 12 and 22 have identical shaped surface contours which reflect signals within substantially identical far-field beam patterns 15 and 25.

The first shaped reflective surface 12 and the second shaped reflective surface 22 are located in an offset and tandem manner. That is, the second reflective surface 22 is positioned behind the first reflective surface 12 and displaced therefrom by offset dimensions X and Y. The first reflective surface 12 has a first focal point 16 along a first focal axis 17 which is equally offset and tandem from the focal point 26 along a second focal axis 27 of the second reflective surface 22. First and second focal axes 17 and 27 are representative of focal axes which would generally be present with parabolic surfaces that may be used to generate the surface contour of the shaped reflectors. First and second feed horns 18 and 28 are located in the vicinity of the first and second focal points 16 and 26 for communicating with the first and second reflective surfaces 12 and 22, respectively. As a consequence, the first and second feed horns 18 and 28 are displaced from one another by offset dimensions X and Y in a manner similar to the arrangement of the reflective surfaces 12 and 22.

Figure 3:
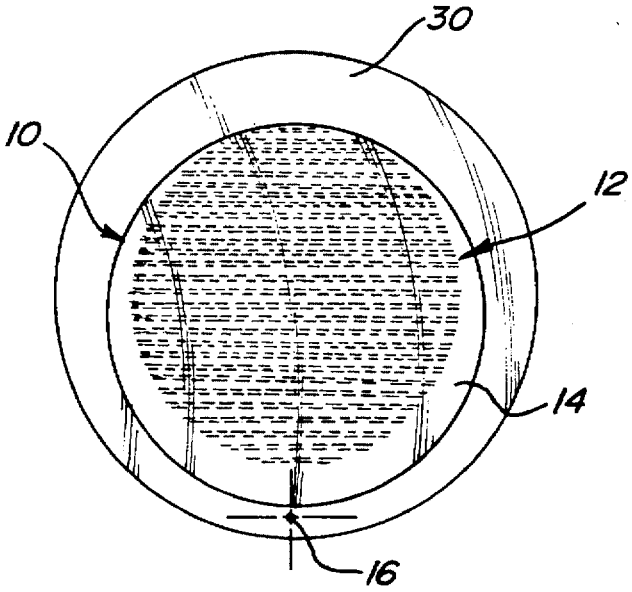
FIG. 3 is a front view of a first shaped reflector being formed with a mandrel in accordance with the present invention.
Figure 4:
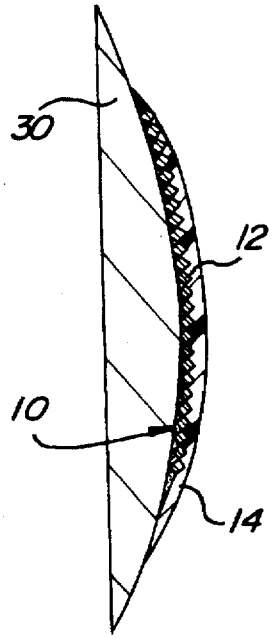
FIG. 4 is a side view of the first shaped reflector and mandrel shown in FIG. 3.
Figure 5:
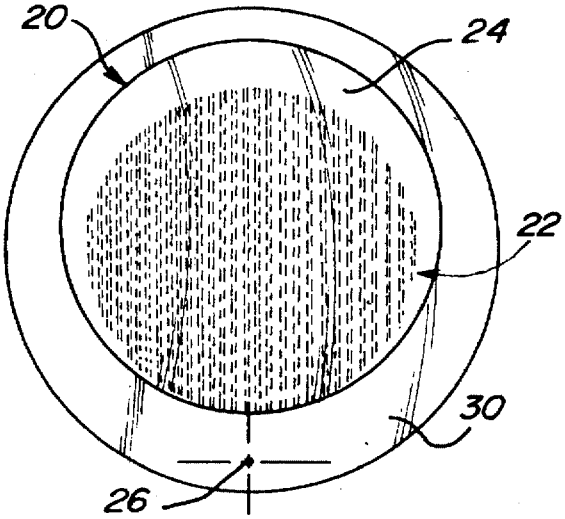
FIG. 5 is a front view of a second shaped reflector being formed with the mandrel in accordance with the present invention.
Figure 6:
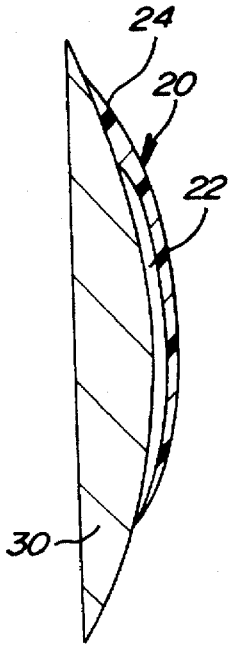
FIG. 6 is a side view of the second shaped reflector and mandrel shown in FIG. 5.

The present invention advantageously provides front and rear shaped reflectors 10 and 20 which may be formed with a single shaped mandrel. With particular reference to FIGS. 3 through 6, the formation of the first and second shaped reflectors 10 and 20 with a single mandrel 30 will now be described. FIGS. 3 and 4 illustrate the fabrication of the front shaped reflector 10 with the mandrel 30. The mandrel 30 generally has a solid surface with a reflective portion thereof which has a surface contour for shaping the shaped reflective surfaces 12 and 22. The mandrel 30 further has a surface which extends beyond the reflective surface portion so as to allow the formation of extensions beyond the reflective portion. As a result, the front reflector 10 may be fabricated with an extension extending to one side of the mandrel 30 while the second reflector 20 has an extension extending to the other side thereof.

The front reflector 10 is fabricated by initially placing grid line strips 13 on the reflective portion of the mandrel 30. A thin plastic material which may include aramid fiber such as Kevlar™ cloth disposed on both sides of a honeycomb core is disposed over the surface of the mandrel 30 which is used to form the first shell-like body member 14. The thin plastic material has approximately a ¼" thickness. The plastic material covers the grid line strips 13 and further covers extended portions of the mandrel 30. The thin plastic material is then cut to form the desired shape of the first shell-like body member 14 and removed from the mandrel 30.

The rear reflector 20 is likewise formed in a similar manner with the same mandrel 30. In doing so, grid line strips 23 are placed on the same reflective portion of the mandrel 30. However, the grid line strips 23 are arranged orthogonal to the grid line strips 13 which form the first reflective surface 12. A similar thin plastic material is disposed on top of the mandrel 30 so as to cover the line strips 23 and extended portions of the mandrel 30. The plastic material is then cut to form the second shell-like body member 24.

As a result, a second reflective surface 22 is formed which has a surface contour identical to the first reflective surface 22. However, the second shell-like body member 24 is generally molded with a different portion of the mandrel 30 and therefore may have a shape different than the first body member 14. The front and rear reflectors 10 and 20 are then arranged one behind the other and held in place by connectors 32.

This invention enables the formation of the front and rear reflectors 10 and 20 with a single mandrel 30. While the reflective portions 12 and 22 and the shell-like body members 14 and 24 have been shown and described in connection with an example thereof, the invention is not limited to the shapes provided herein.

In view of the foregoing, it can be appreciated that the present invention enables the user to achieve two shaped reflectors which may be formed with a single mandrel. Thus, while this invention has been disclosed herein in combination with a particular example thereof, no limitation is intended thereby except as defined in the following claims. This is because a skilled practitioner will recognize that other modifications can be made without departing from the spirit of this invention after studying the specification and drawings.

What is claimed is:

1. A shaped reflector arrangement comprising:

a first body member having a first surface shape;

a first shaped reflective array covering only a portion of the first body member and attached thereto for reflecting signals having a first polarization within a first shaped beam coverage, the first shaped reflective array having a first focal point;

a second body member having a second surface shape different from the first surface shape; and a second shaped reflective array covering only a portion of the second body member and attached thereto for reflecting signals having a second polarization within a second shaped beam coverage, the second shaped reflective array being substantially identical in shape to the first shaped reflective array and having a second focal point, wherein said first body member is positioned directly in front of said second body member and spaced therefrom and said first and second shaped reflective array are arranged in tandem and offset from one another so that said first and second focal points are separate one from the other while said first and second shaped beam coverages are substantially identical.

2. The reflector arrangement as defined in claim 1 wherein said first and second shaped reflective arrays each comprise an array of substantially parallel reflective grid line strips and wherein said first array is arranged orthogonal to said second array for reflecting orthogonally polarized energy.

3. The reflector arrangement as defined in claim 1 wherein said first shaped reflective array is formed on said portion of said first body member and said second shaped reflective array is formed on said portion of said second body member.

4. The reflector arrangement as defined in claim 3 wherein said first and second body members are arranged substantially within a common aperture.

5. The reflector arrangement as defined in claim 3 wherein said first and second shaped reflective arrays are formed with a single casting device.

6. The reflector arrangement as defined in claim 5 wherein said casting device is a mandrel.

7. The reflector arrangement as defined in claim 3 further comprising a connector interposed said first and second body members.

8. The reflector arrangement as defined in claim 1 further comprising:

a first feed horn located near said first focal point for communicating with said first shaped reflective surface; and a second feed horn located near said second focal point for communicating with said second shaped reflective surface.

9. A dual-gridded shaped reflector arrangement for reflecting orthogonally polarized energy, said reflector arrangement comprising:

a first reflector body;

a second reflector body different in shape from said first reflector body and arranged directly behind said first reflector body and spaced therefrom in a tandem arrangement;

a first shaped reflective surface formed on only a portion of said first reflector body and having a first shaped beam coverage and a first focal point; and a second shaped reflective surface formed on only a portion of said second reflector body and having a second shaped beam coverage and a second focal point, wherein said first and second shaped reflective surfaces have substantially identical non-parabolic surface contours with orthogonal reflective arrays and are arranged tandem and offset from each other so that said first and second beam coverages provide substantially identical beam coverage while said first and second focal points are separate one from the other.

10. The reflector arrangement as defined in claim 9 wherein said first and second shaped reflective surfaces each comprise an array of substantially parallel reflective strips, wherein each array forms a pattern orthogonal to the other array.

11. The reflector arrangement as defined in claim 9 further comprising:

a first feed horn located in the vicinity of said first focal point for communicating with said first shaped reflective surface; and a second feed horn located in the vicinity of said second focal point for communicating with said second shaped reflective surface.

12. The reflector arrangement as defined in claim 9 wherein said first and second reflector bodies share a common aperture.

13. The reflector arrangement as defined in claim 9 wherein said first and second reflector bodies and associated first and second shaped reflective surfaces are formed with a single mandrel.

14. The reflector arrangement as defined in claim 9 further comprising a connector interposed said first and second reflector bodies.

15. A method for forming a dual-gridded shaped reflector arrangement with a single mandrel, said method comprising:

forming a first shaped reflective surface with a first array of grid line strips on a portion of said single mandrel;

forming a first reflector body surface with said first shaped reflective surface located on only a portion thereof;

forming a second shaped reflective surface with a second array of grid line strips on said portion of said single mandrel, said first and second shaped reflective surfaces having substantially identical shapes and further having said first and second arrays of grid line strips arranged orthogonal to each other;

forming a second reflector body surface different in shape from said first reflector body surface on said single mandrel with said second shaped reflective surface located on only a portion thereof; and arranging said first and second reflector body surfaces so that said first and second reflective surfaces are in an offset and tandem arrangement such that said first and second shaped reflective surfaces provide substantially identical beam coverage and separate focal points.

16. The method as defined in claim 15 further comprising the step of arranging said first and second reflector body surfaces in a substantially tandem arrangement.

17. The method as defined in claim 15 further comprising the steps of:

placing a first feed horn in the vicinity of the focal point of said first shaped reflective surface; and placing a second feed horn in the vicinity of the focal point of said second shaped reflective surface, and separate from said first feed horn.

18. The method as defined in claim 15 further comprising the step of connecting said first and second reflector body surfaces together.

19. A shaped reflector system for reflecting orthogonally polarized energy, said reflector system comprising:

a first shaped reflective surface having a first reflective array formed on only a portion of a first specially shaped non-parabolic surface contour for providing a first shaped beam coverage;

a second shaped reflective surface having a second reflective array formed on only a portion of a specially shaped non-parabolic surface contour different in shape from the first surface contour, the second shaped reflective surface providing a second shaped beam coverage substantially identical to the first shaped beam coverage, the second reflective array of the second shaped reflective surface arranged orthogonal to the first reflective array of the first shaped reflective surface;

a first feed horn located substantially near a first focal point of said first shaped reflective surface; and a second feed horn located substantially near a second focal point of said second shaped reflective surface, wherein said first and second shaped reflective surfaces are arranged tandem and offset from each other so that said first and second beam coverages provide substantially identical beam coverage while said first and second focal points are separate one from the other.

20. The reflector system as defined in claim 19 wherein said first and second shaped reflective surfaces are shaped with substantially identical mandrels having shaped surface contours to produce substantially identical first and second shaped reflective surfaces.

* * * * *